United States Patent [19]

Parker

[11] Patent Number: 4,541,219

[45] Date of Patent: Sep. 17, 1985

[54] CLIP FOR ATTACHING SHEETS OF WALL MATERIAL TO COLUMNS AND OTHER STRUCTURAL MEMBERS

[76] Inventor: Alvin S. Parker, Two Peter Cooper Rd., New York, N.Y. 10010

[21] Appl. No.: 516,200

[22] Filed: Jul. 22, 1983

[51] Int. Cl.[4] ..... E04C 3/30

[52] U.S. Cl. ..... 52/713; 52/727; 403/231; 403/403; 403/406.1

[58] Field of Search ..... 403/231, 199, 407, 406, 403/403, 205, 345, 331; 52/727, 725, 713, 511, 726, 231, 288, 275

[56] References Cited

U.S. PATENT DOCUMENTS

| | | | |
|---|---|---|---|
| 1,104,346 | 7/1914 | Church . | |
| 2,765,887 | 10/1956 | Horowitz . | |
| 3,113,358 | 12/1963 | Zell et al. | 403/231 X |
| 3,173,178 | 3/1965 | Kumburis | 52/511 |
| 3,300,924 | 1/1967 | Ashby et al. | 52/511 |
| 3,413,775 | 12/1968 | Katz . | |
| 3,722,166 | 3/1973 | McNerney | 52/275 X |
| 3,748,815 | 7/1973 | Parker | 52/727 X |
| 3,761,971 | 10/1973 | Behnke | 403/345 X |
| 4,034,535 | 7/1977 | Dustman | 52/727 |
| 4,270,321 | 6/1981 | Fisher | 52/275 X |
| 4,368,562 | 1/1983 | Minami | 403/345 X |
| 4,389,133 | 6/1983 | Oberst | 403/331 |
| 4,467,584 | 8/1984 | Crites et al. | 52/727 |

*Primary Examiner*—Thomas F. Callaghan

[57] ABSTRACT

A clip for securing drywall panels and like material to structural members and particularly concrete support columns and beams is disclosed. The clip comprises first and second clip members; the first clip member being adapted to be fixably attached to the structural members by means of a suitable fastener. The second clip member is adapted to slidably engage said base member and is provided with a box receiving assembly to which the drywall panels may be secured.

5 Claims, 10 Drawing Figures

CLIP FOR ATTACHING SHEETS OF WALL MATERIAL TO COLUMNS AND OTHER STRUCTURAL MEMBERS

BACKGROUND OF THE INVENTION

1. Field of the Invention

The present invention is directed to clips and more particularly to a pair of cooperating clip members for securing gypsum board and like material to various building structures and particularly to concrete support columns and beams.

2. Description of the Prior Art

In the construction of office buildings, shopping malls and other large structures, it is often necessary, for structural reasons, to position concrete support columns and beams within the interior of the building. As would generally be agreed, these support columns and beams are aesthetically unattractive and are therefore often enclosed using precut sheets of wall material such as drywall or gypsum board.

In the past, a variety of fastening means have been developed in an attempt to decrease the time and labor needed to completely enclose support columns and beams using various types of sheet materials. One such method includes a series of furring channels which are arranged perpendicular to the beams at predetermined intervals. These furring channels are applied to the beams by any convenient means such as adhesives or steel fasteners. Subsequent to positioning the furring channels, the gypsum board is applied to the channels using a variety of fastening means.

Other examples of fastening means used to enclose structural members are contained in the following U.S. Patents:

| Patent Number | Name | Date |
|---|---|---|
| 1,104,346 | Church | July 21, 1914 |
| 1,243,001 | Stewart | Oct. 16, 1917 |
| 2,765,886 | Tedaldi et al. | Oct. 9, 1956 |
| 3,274,739 | Gregoire | Sept. 27, 1966 |
| 3,413,775 | Katz | Dec. 3, 1968 |
| 3,748,815 | Parker | July 31, 1973 |

Although the above prior art methods have met with varying degrees of success in the marketplace, they in many instances require extensive amounts of labor and/or material to completely enclose the structural member.

It is therefore an object of the present invention to provide a clip which will quickly and economically secure a plurality of drywall panels and like materials to all sides of a concrete support column or beam.

It is a further object of the present invention to provide a clip which is simple and rugged in construction and which can be adapted to a large number of column and beam designs.

An additional object of the present invention is to provide a clip which permits faster, less costly enclosure of concrete structural members.

Still other objects and advantages of the present invention will be obvious and in part be apparent from the specification and attached drawings.

SUMMARY OF THE INVENTION

The clip of the present invention comprises first and second clip members; the first clip member being adapted to fixably attach to the structural member to be enclosed by means of a suitable fastener. The second clip member is adapted to slidably engage the first member and is provided with a box receiver assembly for receiving a suitable fastener for holding the drywall or other wall material. In a further use of the present invention, the second clip member is fastened directly to the structural member and the wall material used for enclosing the structural member is thereafter secured to the clip member.

Although the clip of the present invention will be discussed primarily with respect to the enclosure of concrete columns and beams, it should be understood that they may be used to enclose any structural member including those made of wood, steel and other material.

DESCRIPTION OF THE PREFERRED EMBODIMENT

Figure 1:
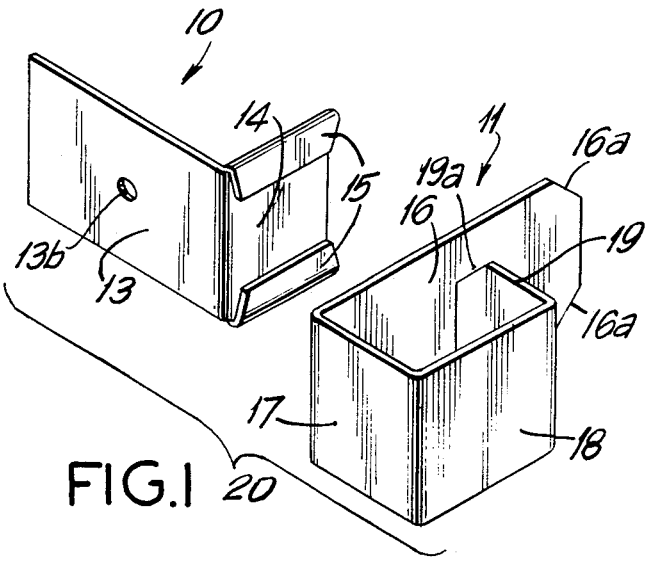
FIG. 1 is a perspective view of the two members of the clip of the present invention.
Figure 2:
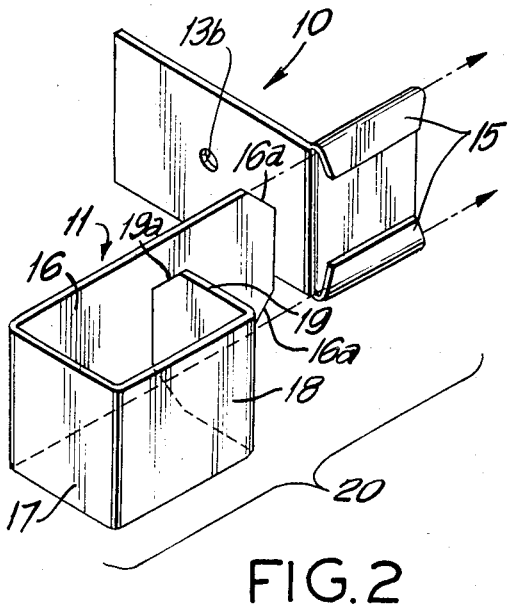
FIG. 2 is a perspective view of the clip of the present invention, showing the two clip members aligned preparatory to slidable engagement.

Referring to the accompanying drawings, wherein like numerals designate similar parts throughout the various views, attention is directed first to FIGS. 1 and 2 wherein the apparatus of the present invention is designated generally by reference number 20. More particularly, the clip of the present invention comprises a first base member 10 and a second support member 11. As can be seen in the drawings, base member 10 comprises an L-shaped element which includes leg portions 13 and 14. Leg portion 14 is provided with flanges 15, which are located on the exterior surface of leg 14, and are adapted to slidingly engage a portion of support member 11.

Support member 11 is a generally U-shaped element comprising back plate 16 and first, second, and third sidewall members which are designated by reference numbers 17, 18, and 19 respectively. Back plate 16, in conjunction with sidewalls 17, 18 and 19 form an open-ended box receiver assembly which, as will be explained further below, is adapted to accept a variety of fastening means for holding the drywall panels securely in place. Although sidewall members 17, 18 and 19 are shown as forming a rectangle in cross-section, their lengths may be varied to suit any particular condition.

Figure 3:
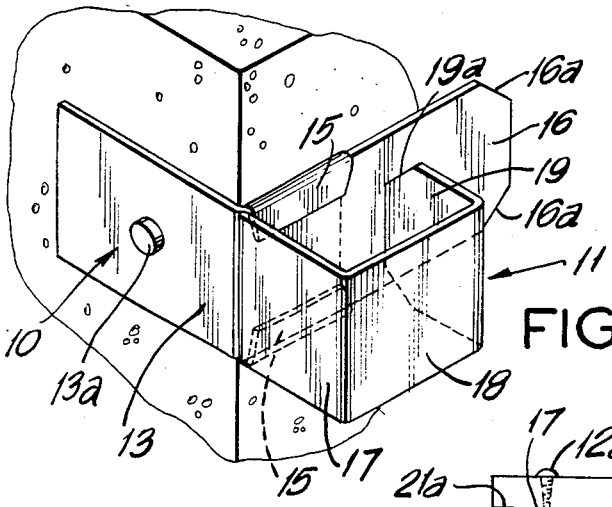
FIG. 3 is a perspective view showing the clip of the present invention attached to a corner of a concrete column.

As illustrated in FIG. 3, back plate 16 is adapted to slidingly engage flanges 15 located on base member 10. In order to facilitate insertion of plate 16 between flanges 15, end portions 16*a* of back plate 16 are angled. Similarly, in order to allow full insertion of plate 16 into base member 10, corners 19*a* of sidewall 19 are also angled so as to allow sidewall 19 to pass over flanges 15 during engagement of the two clip members.

In use, base member 10 is fixably attached to a corner of the structural column to be enclosed using a suitable fastening means 13*a* (FIG. 3). Base member 10 may be provided with aperture 13*b* through which fastening means 13*a* may be driven. Although any number of fastening means, such as steel pins, masonry nails, expansion bolts, may be used, it has been found that a steel pin is most suitable since not only is it relatively inexpensive but it also possesses the necessary strength to be easily driven into a concrete column or beam. After base member 10 is securely fastened to the column, cooperating support member 11 is attached to base member 10 by inserting plate 16 between flanges 15 as shown in FIG. 3. For added strength, an optional fastener (not shown) may be driven through back plate 16 of support member 11 once the support member has been properly positioned.

Figure 4:
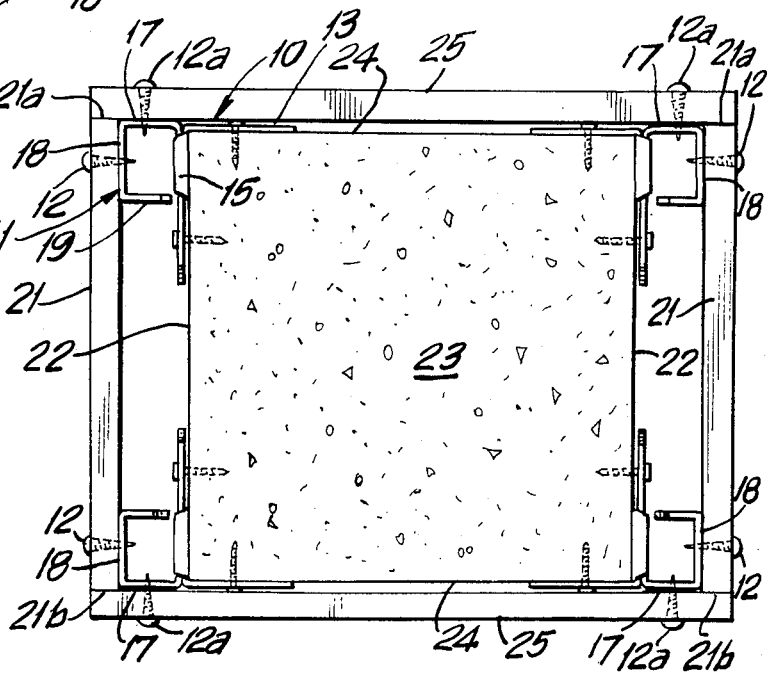
FIG. 4 is a plan view of a concrete support column showing four clips in position with drywall panels secured thereto.

After all the clips are properly positioned as shown in FIG. 4, the column is ready to be enclosed using drywall or like material. In this regard, it is advantageous to first apply the drywall to opposite sides of the column and then to the remaining two sides. This is to assure that the edges of the first applied panels are completely covered by the second panels of drywall, thereby resulting in a clean, more aesthetically pleasing corner. Referring again to FIG. 4, drywall panels 21 are first applied to opposite sides 22 of column 23 such that the horizontal edge portions 21*a* and 21*b* are flush with sides 24 of column 23. Panels 21 are then secured to sidewalls 18 of the box receiver assemblies by fasteners 12. After panels 21 are secured, the remaining sides 24 are covered using drywall panels 25. Panels 25 are fastened to sidewalls 17 of the box receiver assemblies by means of fasteners 12*a*. It has been found that self-tapping sheet metal screws are best suited for securing the drywall panels to the clips.

Figure 5:
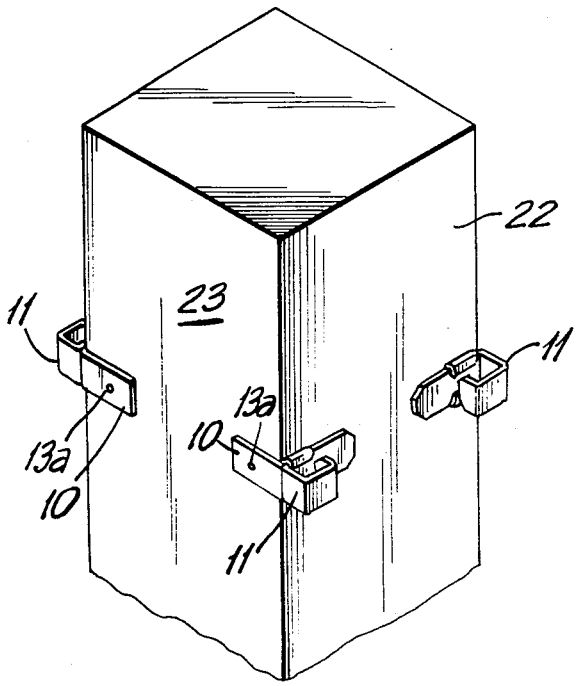
FIG. 5 is a perspective view of a concrete column depicting a plurality of clips attached thereto.

Although an entire column or beam may be enclosed using the clip of the present invention in the manner described above, it has been found that a structure may be enclosed more quickly and efficiently by applying a number of support members 11 directly to the back surfaces of the precut drywall panels, rather than by applying all the clip members to the column and then securing the drywall panels to the clips. Referring to FIG. 5, base members 10 and support members 11 are fastened to the four corners of a column at a point which is approximately midway between the top and bottom of the column. These clips serve to initially secure each drywall panel to the column while additional panels are being secured to the remaining sides.

Figure 6:
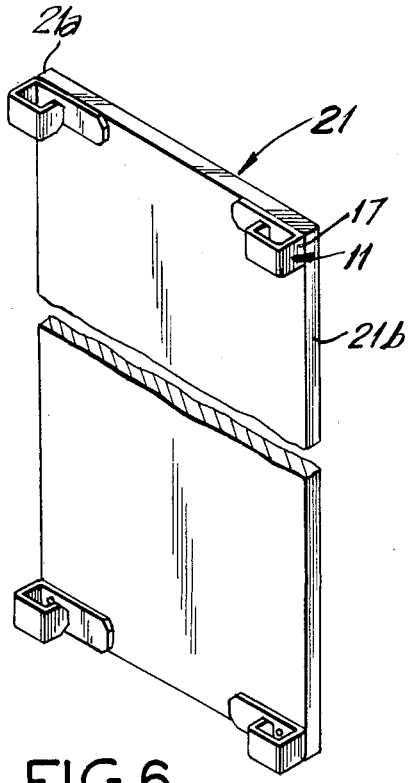
FIG. 6 is a perspective view of the interior side of a drywall panel having a plurality of clip members attached thereto.
Figure 7:
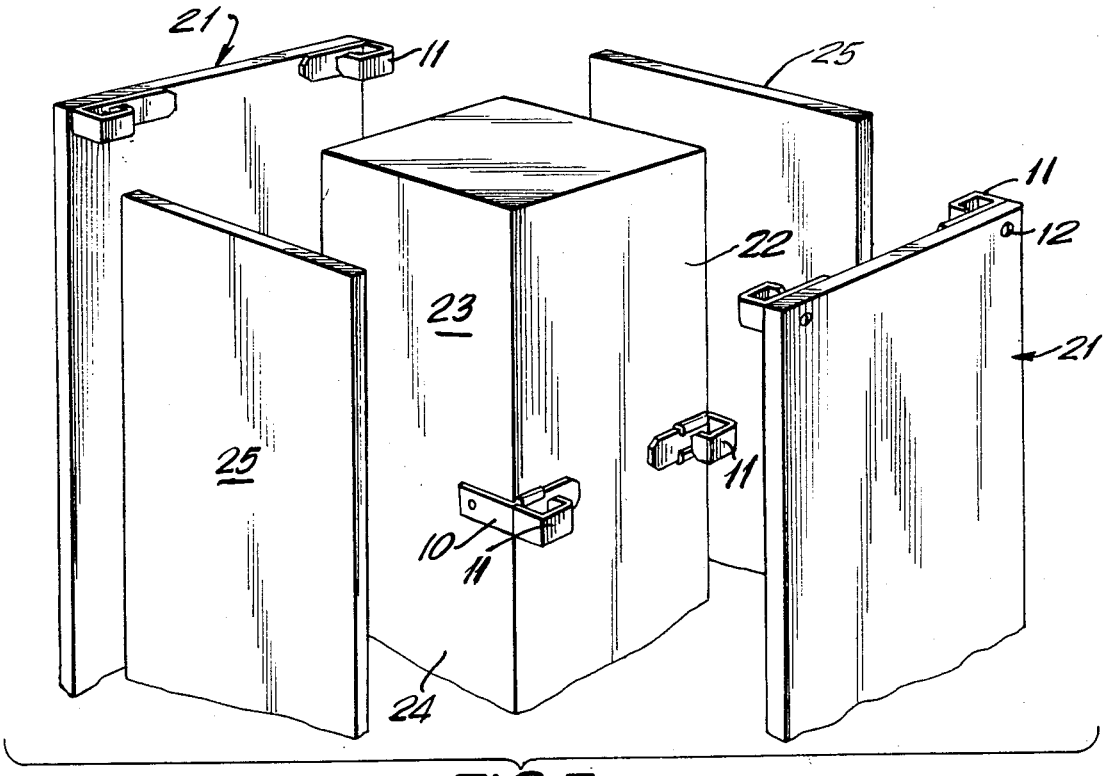
FIG. 7 is a perspective view of a column illustrating the positioning of the drywall panels and clips.

Support members 11 are then positioned on the interior face 21*a* of drywall panels 21 such that sidewall 17 of the box receiving assemblies are flush with horizontal edges 21*a* and 21*b* of panel 21 (FIG. 6). Support members 11 are secured to panels 21 by framing screws 12 which are applied from the exterior face of the drywall panels. Panels 21 are then secured to opposite sides 22 of column 23 by framing screws which pass through the drywall and into the box receiving assembly of the clip members previously attached to the column. This initial attachment holds the panels securely in place, thereby allowing a single workmen to apply additional panels. After panels 21 are initially secured to opposite sides 22 of column 23, two additional panels 25 are secured to the remaining two sides 24 of the column at its midpoint as shown in FIG. 7. After all four panels have been initially secured to the column at its midpoint, the top and bottom of panels 25 are fastened to support members 11 located at the top and bottom portions of panels 21.

The above method not only allows one person to easily and efficiently enclose a concrete column, but it also results in a less costly installation since base members 10 are only applied to the column at its midpoint. Moreover, using the above method, it is unnecessary to fasten all of the clips to the column.

Although each support member 11 is retained within base member 10 by flanges 15, there is no danger that they will slide outward from flanges 15 since they are locked in position by the drywall and framing screws. The construction as explained above is therefore permanent and secure while the clips are hidden from view.

Figure 8:
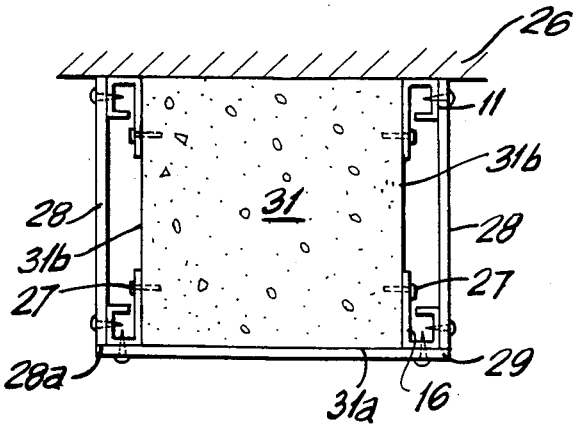
FIG. 8 is section-view of a beam illustrating the placement of the clips and drywall panels.

The clip of the present invention may also be used to enclose beams or other structural members which protrude from ceilings or other flat surfaces as shown in FIG. 8. When enclosing structural members such as this it is only necessary that the support member 11 of the clip be used. Specifically, support members 11 are positioned on beam 31 in such a manner that their box receiver assemblies are proximate to ceiling 26 from which the beam protrudes. Support members 11 are then secured to the beam by steel pins 27 which pierce back plate 16. A second pair of support members are fastened to the lower corners of the beam so that sidewalls 17 of the box receiver assemblies are flush with the lower surface 31 of beam 31. Once the clip members are installed, drywall panels 28 are applied to opposite sides 31*b* of beam 31. Similarly, a third drywall panel 29 is secured to the bottom of the beam such that it covers support members 11 and edges 28*a* of panels 28.

Figure 9:
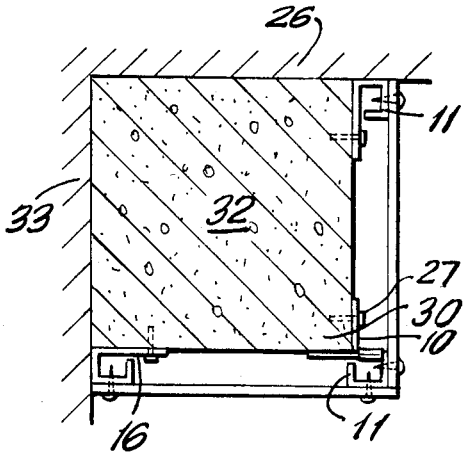
FIG. 9 is a cross section view through a spandrel beam illustrating the placement of the clips and drywall panels.

In a further use of the present invention, shown in FIG. 9, the clip of the present invention is used to enclose a spandrel beam. As seen, support members 11 are positioned on spandrel beam 32 so that sidewalls 17 of the box receiver assemblies are in contact with wall 33 and ceiling 26. Support members 11 are fastened to the beam by means of fasteners 27 which pierce back plate 16. At the corner of the spandrel beam which is designated generally as reference number 30, a base member 10 and support member 11 are positioned.

Figure 10:
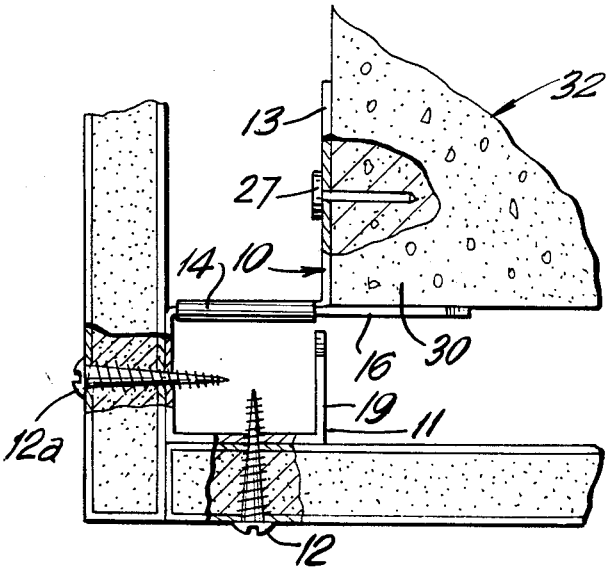
FIG. 10 is an enlarged end-view of the clip of the present invention positioned on the corner of a spandrel beam.

As shown in detail in FIG. 10, base member 10 is positioned on the spandrel column such that leg 14 extends perpendicular to the side of the beam to which member 10 is attached. Although base member 10 may be attached to the column so that legs 13 and 14 extend around the corner of the column, (FIG. 3), it has been found that attaching base member 10 as shown in FIG. 10 provides greater rigidity and strength to the support member. After base member 10 is secured to the beam, support member 11 is positioned between flanges 15 and the drywall material is secured to the clips using fasteners 12 and 12*a* as previously discussed and as shown in FIG. 9.

Although the apparatus of the present invention may be constructed of a variety of different materials, one should keep in mind when selecting the materials to be used, the mechanical stresses and conditions to which the clips will be subjected to in ordinary use. It has been found that the clips of the present invention may be stamped or otherwise cut from relatively heavy gauge sheet metal and then bent to the desired shapes. Preferably, the sheet metal is galvanized or otherwise protected from rust. The clip may, however, be extruded aluminum or plastic or may be formed of any suitable material. As would be understood by one skilled in the art, the thickness and weight of the material which is to be used to enclose the columns will to some degree dictate the type and gauge of the clip material.

Since from the foregoing the construction and advantage of the device may be readily understood, further explanation is believed to be unnecessary. However, since numerous modifications will readily occur to those skilled in the art after a consideration of the foregoing specification and accompanying drawings, it is not intended that the invention be limited to the exact construction shown and described, but all suitable modifications and equivalents may be resorted to which fall within the scope of the appended claims. Having described the invention,

What is claimed is:

1. A clip for permanently securing preformed sheets of wall material to a structural member comprising a base member, said base member being generally L-shaped and comprising first and second leg members, said base member being provided with a pair of flanges with said leg member to form oppositely facing channels, said clip further including a support member, said support member comprising a back plate and first, second and third sidewalls, said back plate and sidewalls being sequentially attached so as to form an open-ended box-like fastener receiver assembly; said receiver assembly having a width approximately equal to that of said base member and adapted to receive fastener means for securing said preformed sheets of wall material and said back plate adapted to slidably engage the channels formed by said flanges located on said base member.

2. The clip of claim 1 wherein the corner end portions of said back plate distal to said first sidewall are angled so as to facilitate insertion of said back plate between the flanges located on said base member.

3. The clip of claim 1 wherein the corner end portions of said third sidewall are angled so as to allow the end portion of said third sidewall to pass over the flanges located on the base member when the back plate is inserted between said flanges.

4. The clip of claims 1 or 2 wherein said clip is formed of a substantially rigid yet deformable material.

5. The clip of claim 3 wherein said clip is formed of galvanized sheet metal.

* * * * *